US009423135B2

(12) United States Patent
Hughes et al.

(10) Patent No.: US 9,423,135 B2
(45) Date of Patent: Aug. 23, 2016

(54) COMBUSTOR HAVING MIXING TUBE BUNDLE WITH BAFFLE ARRANGEMENT FOR DIRECTING FUEL

(71) Applicant: General Electric Company, Schenectady, NY (US)

(72) Inventors: Michael John Hughes, Pittsburgh, PA (US); Johnie Franklin McConnaughhay, Greenville, SC (US)

(73) Assignee: General Electric Company, Schenectady, NY (US)

( * ) Notice: Subject to any disclaimer, the term of this patent is extended or adjusted under 35 U.S.C. 154(b) by 385 days.

(21) Appl. No.: 14/085,887

(22) Filed: Nov. 21, 2013

(65) Prior Publication Data

US 2015/0135718 A1 May 21, 2015

(51) Int. Cl.

| | |
|---|---|
| ***F23R 3/28*** | (2006.01) |
| ***F23R 3/10*** | (2006.01) |
| ***F23D 14/70*** | (2006.01) |
| *F23D 14/64* | (2006.01) |

(52) U.S. Cl.

CPC ..... *F23R 3/286* (2013.01); *F23D 14/70* (2013.01); *F23R 3/10* (2013.01); *F23D 14/64* (2013.01)

(58) Field of Classification Search

CPC ..... F23R 3/283; F23R 3/286; F23R 3/10; F23D 14/62; F23D 14/64; F23D 14/02; F23D 14/70

USPC ..... 60/737, 738; 165/DIG. 210; 239/397.5

See application file for complete search history.

(56) References Cited

U.S. PATENT DOCUMENTS

| | | | | |
|---|---|---|---|---|
| 4,100,733 | A * | 7/1978 | Striebel | F23R 3/286 239/419.3 |
| 7,886,991 | B2 | 2/2011 | Zuo et al. | |
| 8,007,274 | B2 | 8/2011 | Johnson et al. | |
| 8,112,999 | B2 | 2/2012 | Zuo | |
| 8,141,334 | B2 | 3/2012 | Johnson et al. | |
| 8,147,121 | B2 | 4/2012 | Lacy et al. | |
| 8,157,189 | B2 | 4/2012 | Johnson et al. | |
| 8,181,891 | B2 * | 5/2012 | Ziminsky | F23D 14/48 239/132 |
| 8,955,327 | B2 * | 2/2015 | Barker | F23R 3/286 239/397.5 |
| 2009/0031728 | A1 | 2/2009 | Miura et al. | |
| 2010/0031662 | A1 * | 2/2010 | Zuo | F23D 14/78 60/740 |
| 2010/0139280 | A1 | 6/2010 | Lacey et al. | |
| 2010/0180600 | A1 | 7/2010 | Lacey et al. | |
| 2010/0186413 | A1 | 7/2010 | Lacey et al. | |
| 2010/0192581 | A1 | 8/2010 | Ziminsky et al. | |
| 2010/0218501 | A1 | 9/2010 | York et al. | |
| 2010/0252652 | A1 * | 10/2010 | Johnson | F23D 14/62 239/132 |
| 2011/0072824 | A1 | 3/2011 | Zuo et al. | |
| 2011/0073684 | A1 * | 3/2011 | Johnson | F23D 14/02 239/553.5 |
| 2011/0083439 | A1 * | 4/2011 | Zuo | F23D 14/64 60/737 |
| 2012/0006030 | A1 | 1/2012 | Uhm et al. | |
| 2012/0079829 | A1 | 4/2012 | Berry et al. | |
| 2013/0084534 | A1 * | 4/2013 | Melton | F23R 3/10 431/2 |
| 2013/0115561 | A1 * | 5/2013 | Melton | F23R 3/286 431/8 |
| 2013/0122435 | A1 * | 5/2013 | Stoia | F23R 3/286 431/12 |
| 2013/0192234 | A1 * | 8/2013 | Stewart | F23R 3/286 60/772 |

* cited by examiner

*Primary Examiner* — Phutthiwat Wongwian
*Assistant Examiner* — Alain Chau
(74) *Attorney, Agent, or Firm* — Dority & Manning, PA

(57) ABSTRACT

A combustor includes a tube bundle that extends radially across at least a portion of the combustor. The tube bundle includes an upstream surface axially separated from a downstream surface, and a plurality of tubes extend from the upstream surface through the downstream surface to provide fluid communication through the tube bundle. A barrier extends radially inside the tube bundle between the upstream and downstream surfaces, and a baffle extends axially inside the tube bundle between the upstream surface and the barrier.

14 Claims, 7 Drawing Sheets

COMBUSTOR HAVING MIXING TUBE BUNDLE WITH BAFFLE ARRANGEMENT FOR DIRECTING FUEL

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present invention generally involves a combustor and method for distributing fuel in the combustor.

BACKGROUND OF THE INVENTION

Combustors are commonly used in industrial and power generation operations to ignite fuel to produce combustion gases having a high temperature and pressure. For example, turbomachines such as gas turbines typically include one or more combustors to generate power or thrust. A typical gas turbine includes an inlet section, a compressor section, a combustion section, a turbine section, and an exhaust section. The inlet section cleans and conditions a working fluid (e.g., air) and supplies the working fluid to the compressor section. The compressor section increases the pressure of the working fluid and supplies a compressed working fluid to the combustion section. The combustion section mixes fuel with the compressed working fluid and ignites the mixture to generate combustion gases having a high temperature and pressure. The combustion gases flow to the turbine section where they expand to produce work. For example, expansion of the combustion gases in the turbine section may rotate a shaft connected to a generator to produce electricity.

The combustion section may include multiple combustors annularly arranged between the compressor section and the turbine section, and various parameters influence the design and operation of the combustors. For example, higher combustion gas temperatures generally improve the thermodynamic efficiency of the combustor. However, higher combustion gas temperatures also promote flame holding conditions in which the combustion flame migrates towards the fuel being supplied by nozzles, possibly causing accelerated damage to the nozzles in a relatively short amount of time. In addition, higher combustion gas temperatures generally increase the disassociation rate of diatomic nitrogen, increasing the production of nitrogen oxides ($NO_X$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, the combustor may include an end cap that extends radially across at least a portion of the combustor. A plurality of tubes may be radially arranged in one or more tube bundles across the end cap to provide fluid communication for the compressed working fluid through the end cap and into a combustion chamber. Fuel supplied to a fuel plenum inside the end cap may flow around the tubes and provide convective cooling to the tubes before flowing across a baffle and into the tubes. The fuel and compressed working fluid mix inside the tubes before flowing out of the tubes and into the combustion chamber.

Although effective at enabling higher operating temperatures while protecting against flame holding and controlling undesirable emissions, the fuel flowing around and into the tubes may become unevenly heated, resulting in variations in the density and therefore the flow rate of fuel flowing into each tube. In addition, the temperature of the fuel may be significantly lower than the temperature of the compressed working fluid flowing around the end cap and through the tubes, creating undesirable thermal stresses across the end cap, baffle, and/or tubes that may reduce the low cycle fatigue limits of the combustor. As a result, a combustor and method for distributing fuel in the combustor that addresses one or more of these deficiencies would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor that includes a tube bundle that extends radially across at least a portion of the combustor. The tube bundle includes an upstream surface axially separated from a downstream surface, and a plurality of tubes extend from the upstream surface through the downstream surface to provide fluid communication through the tube bundle. A barrier extends radially inside the tube bundle between the upstream and downstream surfaces, and a baffle extends axially inside the tube bundle between the upstream surface and the barrier.

Another embodiment of the present invention is a combustor that includes a tube bundle that extends radially across at least a portion of the combustor. The tube bundle includes an upstream surface, and a shroud circumferentially surrounds the upstream surface to at least partially define a fuel plenum inside the tube bundle. A plurality of tubes extend through the upstream surface of the tube bundle to provide fluid communication through the tube bundle. A barrier extends radially inside the fuel plenum downstream from the upstream surface, and the combustor further includes means for radially directing fuel inside the fuel plenum.

The present invention may also include a gas turbine having a compressor, a combustor downstream from the compressor, and a turbine downstream from the combustor. A tube bundle extends radially across at least a portion of the combustor. The tube bundle includes an upstream surface axially separated from a downstream surface, and a shroud circumferentially surrounds the upstream and downstream surfaces to at least partially define a fuel plenum inside the tube bundle. A plurality of tubes extend from the upstream surface through the downstream surface of the tube bundle to provide fluid communication through the tube bundle. A barrier extends radially inside the fuel plenum between the upstream and downstream surfaces, and a baffle extends axially inside the fuel plenum between the upstream surface and the barrier.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
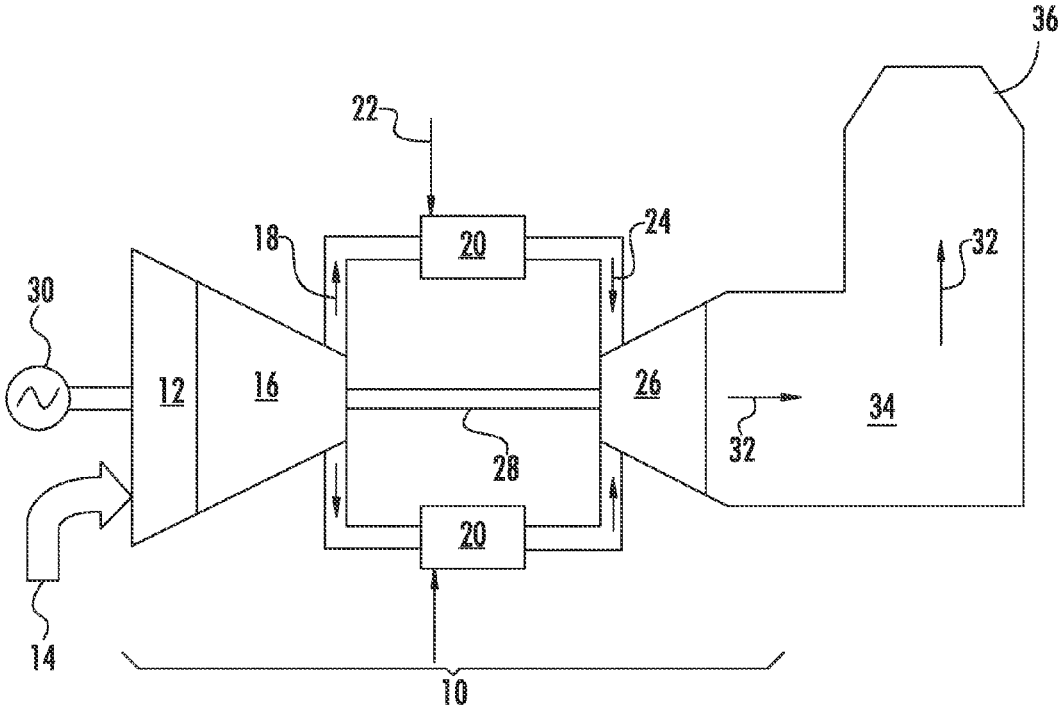
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream," "downstream," "radially," and "axially" refer to the relative direction with respect to fluid flow in a fluid pathway. For example, "upstream" refers to the direction from which the fluid flows, and "downstream" refers to the direction to which the fluid flows. Similarly, "radially" refers to the relative direction substantially perpendicular to the fluid flow, and "axially" refers to the relative direction substantially parallel to the fluid flow.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor and method for distributing fuel in the combustor. The combustor generally includes a tube bundle having a plurality of tubes that allow fuel and compressed working fluid to thoroughly mix before entering a combustion chamber. A barrier, baffle, or other means extend radially and/or axially inside the tube bundle to enhance distribution of the fuel inside the tube bundle. Although exemplary embodiments of the present invention will be described generally in the context of a combustor incorporated into a turbomachine such as a gas turbine for purposes of illustration, one of ordinary skill in the art will readily appreciate that embodiments of the present invention may be applied to any combustor and are not limited to a turbomachine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state. The compressed working fluid 18 flows to a combustion section where one or more combustors 20 ignite fuel 22 with the compressed working fluid 18 to produce combustion gases 24 having a high temperature and pressure. The combustion gases 24 flow through a turbine section to produce work. For example, a turbine 26 may connect to a shaft 28 so that rotation of the turbine 26 drives the compressor 16 to produce the compressed working fluid 18. Alternately or in addition, the shaft 28 may connect the turbine 26 to a generator 30 for producing electricity. Exhaust gases 32 from the turbine 26 flow through an exhaust section 34 that may connect the turbine 26 to an exhaust stack 36 downstream from the turbine 26. The exhaust section 34 may include, for example, a heat recovery steam generator (not shown) for cleaning and extracting additional heat from the exhaust gases 32 prior to release to the environment.

Figure 2:
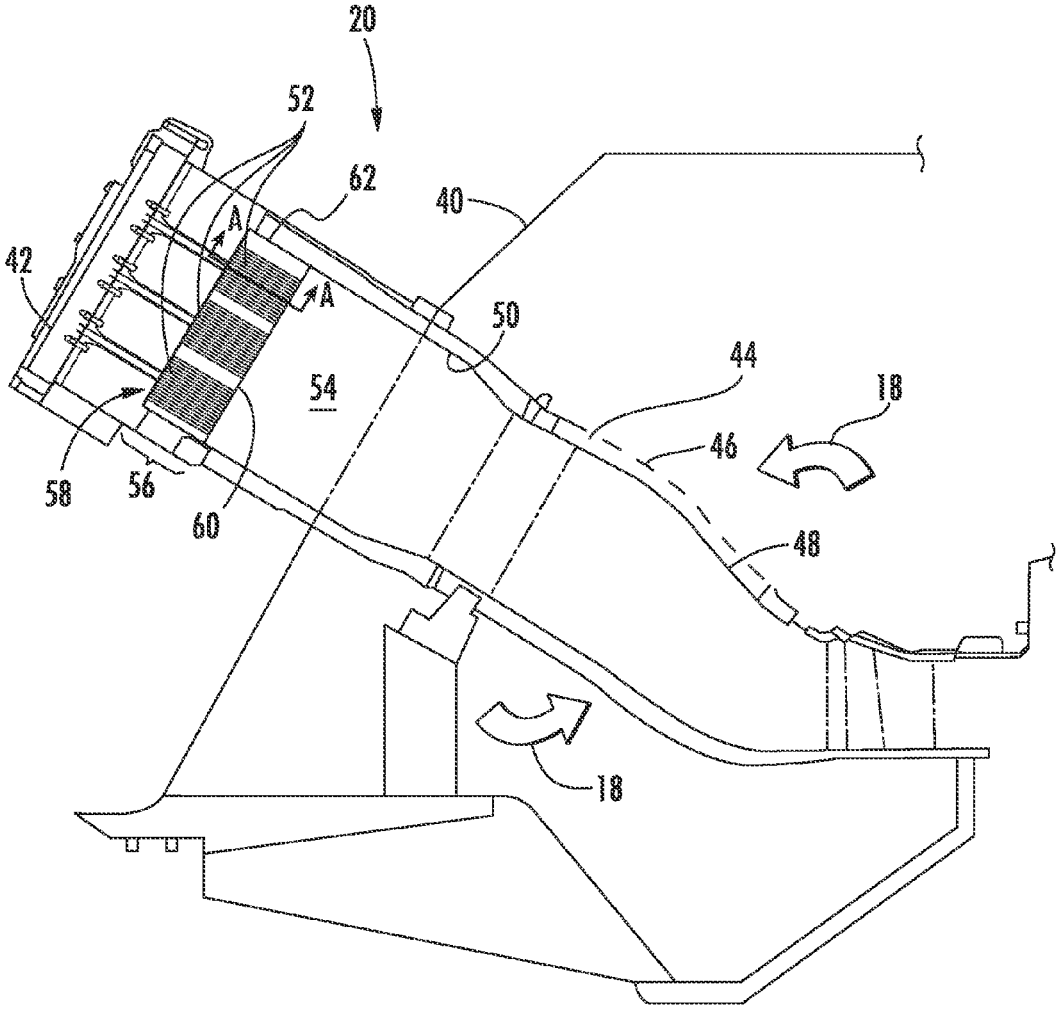
FIG. 2 is a simplified side cross-section view of an exemplary combustor according to various embodiments of the present invention.

The combustors 20 may be any type of combustor known in the art, and the present invention is not limited to any particular combustor design unless specifically recited in the claims. FIG. 2 provides a simplified side cross-section view of an exemplary combustor 20 according to various embodiments of the present invention. As shown in FIG. 2, a casing 40 and an end cover 42 may surround the combustor 20 to contain the compressed working fluid 18 flowing to the combustor 20. The compressed working fluid 18 may pass through flow holes 44 in an impingement sleeve 46 to flow along the outside of a transition piece 48 and liner 50 to provide convective cooling to the transition piece 48 and liner 50. When the compressed working fluid 18 reaches the end cover 42, the compressed working fluid 18 reverses direction to flow through a plurality of tubes 52 into a combustion chamber 54.

The tubes 52 are radially arranged in an end cap 56 upstream from the combustion chamber 54. As shown, the end cap 56 generally extends radially across at least a portion of the combustor 20 and may include an upstream surface 58 axially separated from a downstream surface 60. A cap shield or shroud 62 may circumferentially surround the upstream and downstream surfaces 58, 60. Each tube 52 may extend from the upstream surface 58 and/or through the downstream surface 60 of the end cap 56 to provide fluid communication for the compressed working fluid 18 to flow through the end cap 56 and into the combustion chamber 54.

Figure 3:
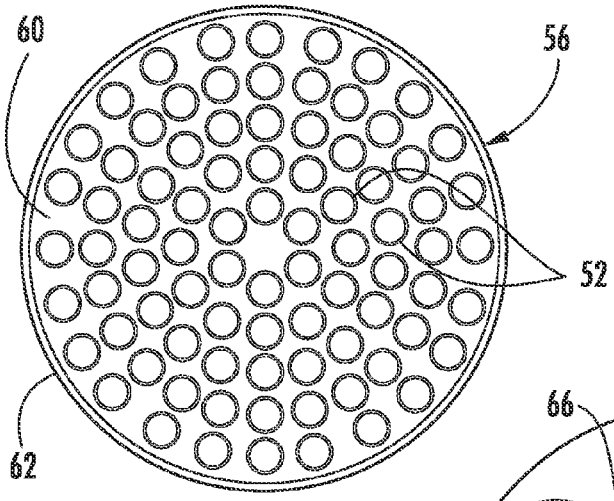
FIG. 3 is a cross-section view of the end cap shown in FIG. 2 taken along line A-A according to an embodiment of the present invention.
Figure 4:
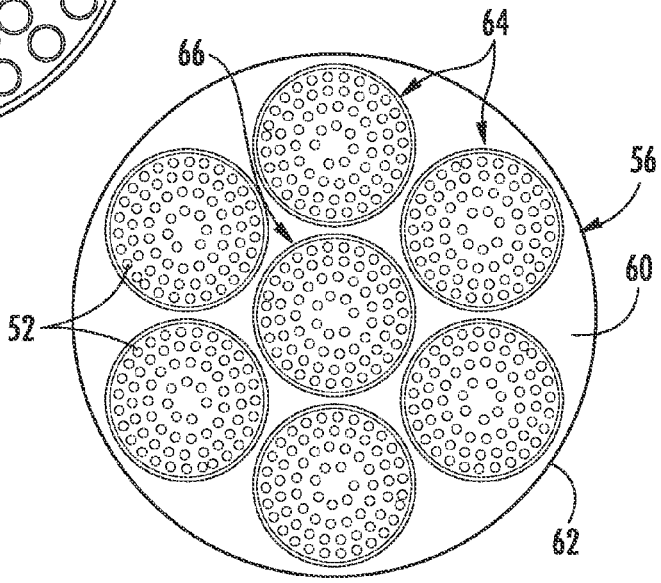
FIG. 4 is a cross-section view of the end cap shown in FIG. 2 taken along line A-A according to an embodiment of the present invention.
Figure 5:
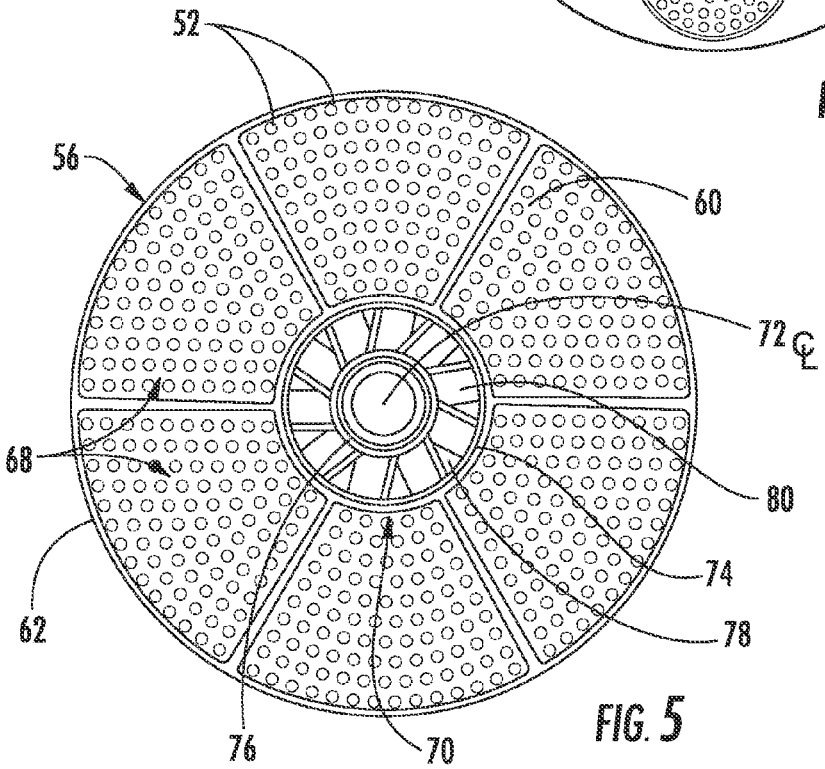
FIG. 5 is a cross-section view of the end cap shown in FIG. 2 taken along line A-A according to an embodiment of the present invention.

Various embodiments of the combustor 20 may include different numbers, shapes, and arrangements of tubes 52 separated into various bundles across the end cap 56, and FIGS. 3-5 provide upstream views of the end cap 56 according to various exemplary embodiments. Although generally illustrated as cylindrical tubes in each embodiment, the cross-section of the tubes 52 may be any geometric shape, and the present invention is not limited to any particular cross-section unless specifically recited in the claims. The tubes 52 in each bundle may be grouped in circular, triangular, square, or other geometric shapes, and the bundles may be arranged in various numbers and geometries in the end cap 56. For example, in the embodiment shown in FIG. 3, the tubes 52 are radially arranged across the end cap 56 as a single tube bundle. In contrast, FIG. 4 shows the tubes 52 arranged, for example, in six outer tube bundles 64 radially surrounding a single center tube bundle 66. In the particular embodiment shown in FIG. 5, the tubes 52 are arranged in six pie-shaped tube bundles 68 that circumferentially surround a single fuel nozzle 70 aligned with an axial centerline 72 of the end cap 56. The fuel nozzle 70 may include, for example, a shroud 74 that circumferentially surrounds a center body 76 to define an annular passage 78 between the shroud 74 and the center body 76. One or more swirler vanes 80 may be located between the shroud 74 and the center body 76 to impart swirl to the compressed working fluid 18 flowing through the annular passage 78. In this manner, the fuel nozzle 70 may provide fluid communication through the end cap 56 to the combustion chamber 54 separate and apart from the tubes 52.

FIGS. 6-9 provide partial perspective side cross-section views of an exemplary bundle 90 according to various embodiments of the present invention. As shown in each figure, the tube bundle 90 generally extends radially across at least a portion of the end cap 56, and the tubes 52 extend axially between the upstream and downstream surfaces 58, 60 to provide fluid communication for the compressed working fluid 18 to flow through the tube bundle 90 and into the combustion chamber 54. A barrier 94 may extend radially between the upstream and downstream surfaces 58, 60 so that the upstream surface 58, shroud 62, and barrier 94 generally define a fuel plenum 92 inside the tube bundle 90.

One or more conduits may provide fluid communication for fuel 22, diluents, and/or other additives to flow into the fuel plenum 92 and/or through the end cap 56 and into the combustion chamber 54. For example, as shown in FIGS. 6-9, an inner conduit 96 may extend through the upstream and downstream surfaces 58, 60 to supply fuel 22 directly through the end cap 56 to the combustion chamber 54. An outer conduit 98 may surround the inner conduit 96 to define an annulus 100 between the inner and outer conduits 96, 98. In this manner, fuel 22 may flow through the annulus 100 and into the fuel plenum 92 to provide convective cooling to the tubes 52 and pre-heat the fuel 22. The fuel 22 may then flow through fuel ports 104 in one or more tubes 52 to mix with the compressed working fluid 18 inside the tubes 52 before flowing into the combustion chamber 54. The fuel ports 104 may be angled radially, axially, and/or azimuthally to project and/or impart swirl to the fuel 22 flowing through the fuel ports 104 and into the tubes 52. In this manner, the compressed working fluid 18 may flow into the tubes 52, and the fuel 22 from the fuel plenum 92 may flow through the fuel ports 104 and into the tubes 52 to mix with the compressed working fluid 18. The fuel-working fluid mixture may then flow through the tubes 52 and into the combustion chamber 54.

The fuel 22 flowing around and into the tubes 52 may become unevenly heated, resulting in variations in the density of the fuel 22 flowing into the fuel ports 104. In addition, the temperature of the fuel 22 may be significantly lower than the temperature of the compressed working fluid 18 flowing around the end cap 56 and through the tubes 52, creating undesirable thermal stresses across the tubes 52, upstream surface 58 and/or barrier 94 that may reduce the low cycle fatigue limits of the combustor 20. As a result, each tube bundle 90 further includes means for radially directing the fuel 22 inside the fuel plenum 92 to more evenly distribute and heat the fuel 22 as it flows through the fuel plenum 92. The structure associated with the means may include a baffle that extends axially inside the tube bundle 90 between the upstream surface 58 and the barrier 94. The structure may include, for example, any combination of guides, plates, vanes, or other baffles suitable for continuous exposure in the temperatures and pressures associated with the fuel plenum 92. In particular embodiments, the structure may further include one or more connections to the upstream surface 58, barrier 94, and/or outer conduit 98 to locate the means inside the fuel plenum 92.

Figure 6:
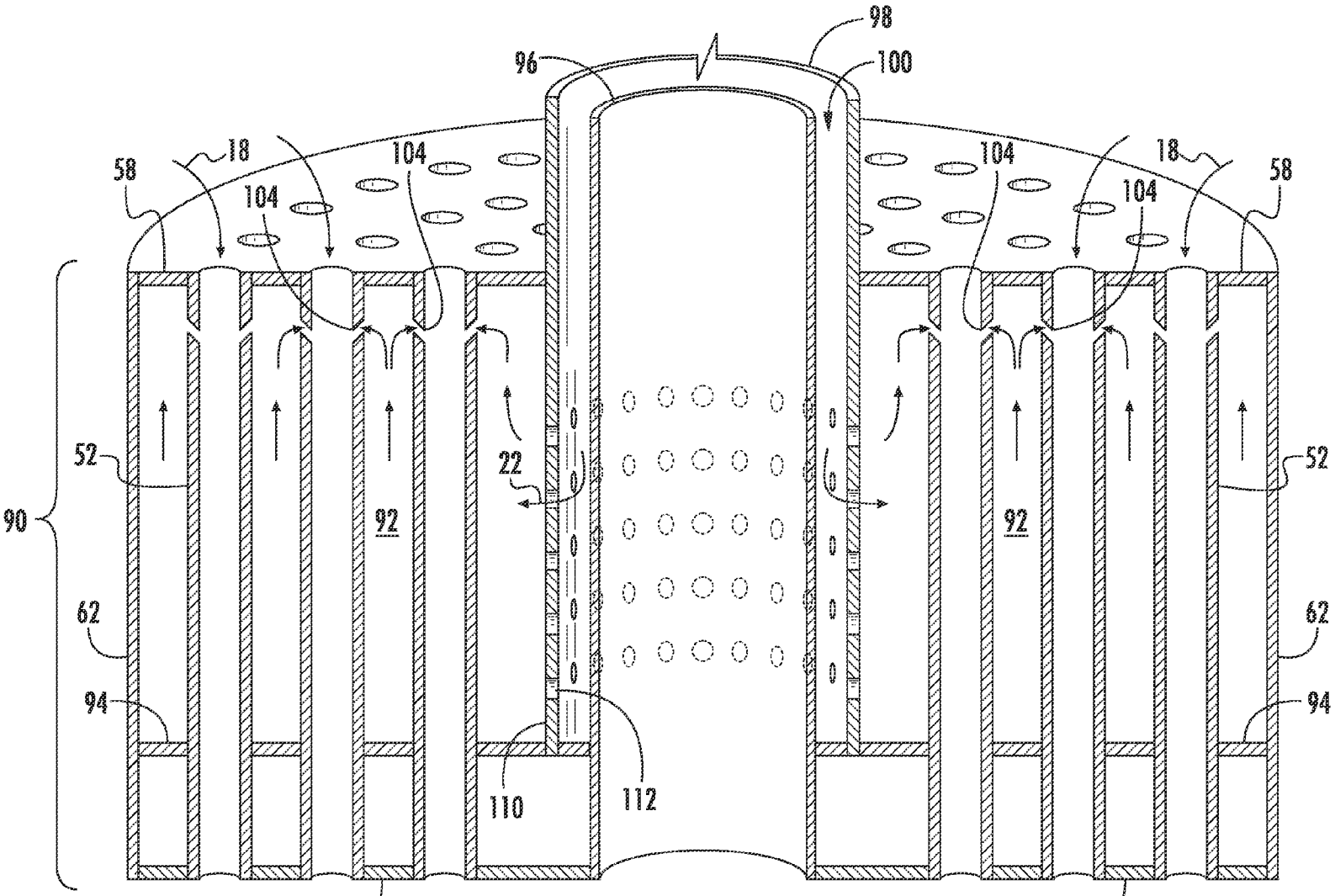
FIG. 6 is a partial perspective, side cross-section view of a tube bundle according to a first embodiment of the present invention.

FIG. 6 provides a partial perspective side cross-section view of the exemplary tube bundle 90 according to a first embodiment of the present invention. In the particular embodiment shown in FIG. 6, the structure associated with the means for radially directing the fuel 22 inside the fuel plenum 92 is a cylinder 110 with perforations 112. The cylinder 110 extends axially inside the tube bundle 90 substantially parallel to the tubes 52 between the upstream surface 58 and the barrier 94. As shown in FIG. 6, the cylinder 110 connects to the upstream surface 58 and the barrier 94 to locate the cylinder 110 inside the fuel plenum 92. In other particular embodiments, the cylinder 110 may connect to one or more of the upstream surface 58, the barrier 94, and/or the outer conduit 98, as desired. As shown in FIG. 6, the perforations 112 in the cylinder 110 radially direct the fuel 22 flowing into the fuel plenum 92 to facilitate more even heating and flow of the fuel 22 inside the fuel plenum 92. In particular embodiments, the perforations 112 may be non-uniform to preferentially direct fuel 22 to particular locations in the tube bundle.

Figure 7:
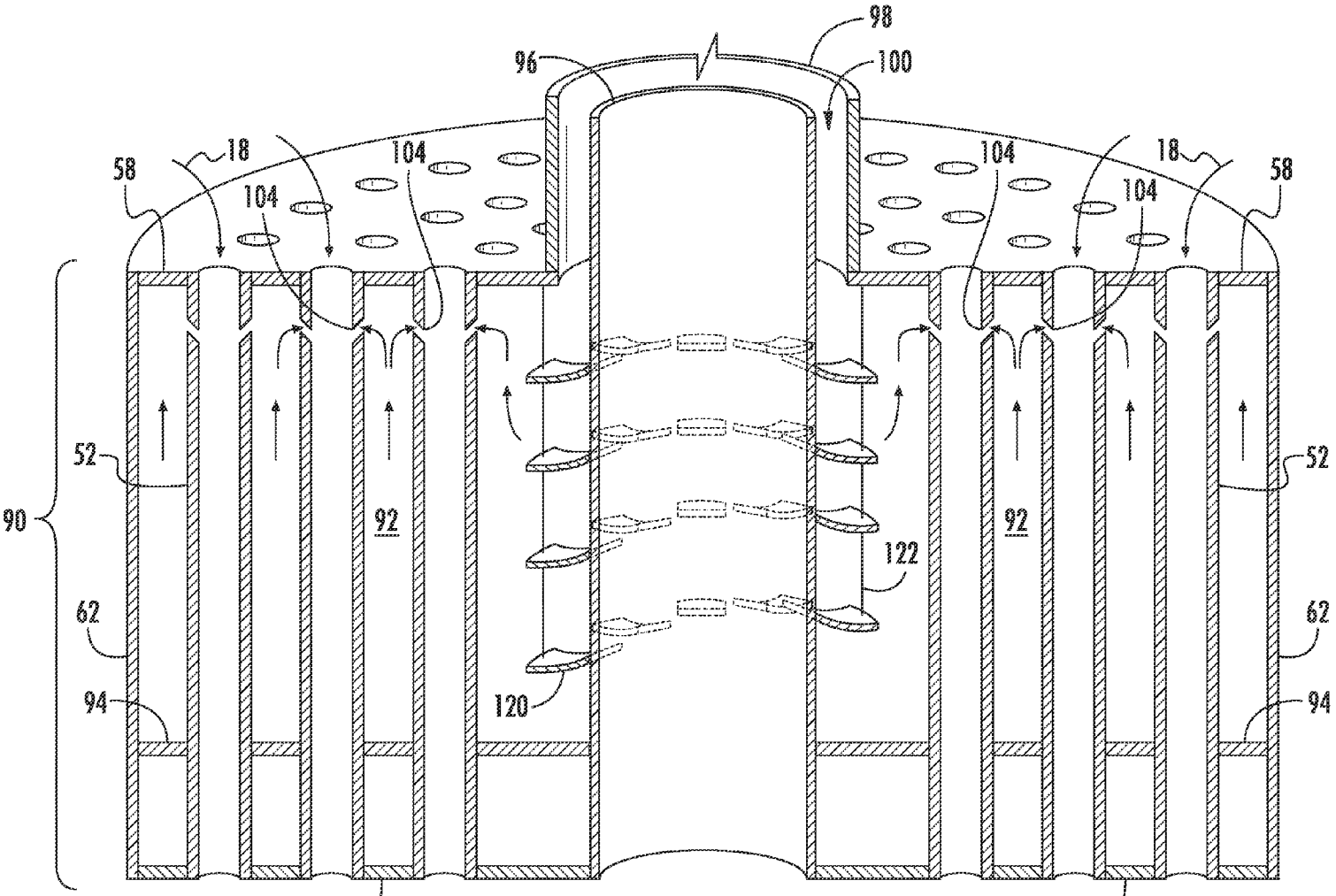
FIG. 7 is a partial perspective side cross-section view of a tube bundle according to a second embodiment of the present invention.

FIG. 7 provides a partial perspective side cross-section view of the exemplary tube bundle 90 according to a second embodiment of the present invention. In the particular embodiment shown in FIG. 7, the structure associated with the means for radially directing the fuel 22 inside the fuel plenum 92 is a plurality of curved guides 120 that extend radially from the inner conduit 96. The curved guides 120 are arranged axially inside the tube bundle 90 substantially parallel to the tubes 52 between the upstream surface 58 and the barrier 94. The curvature and/or length of the curved guides 120 may be the same or different. As shown in FIG. 7, a wire 122 or other structure may connect the curved guides 120 to the outer conduit 98 and/or the barrier 94 to provide additional support to the curved guides 120 inside the fuel plenum 92. In other particular embodiments, the wire 122 may connect the curved guides 120 to one or more of the upstream surface 58, the barrier 94, and/or the outer conduit 98, as desired. As shown in FIG. 7, the curved guides 120 radially direct the fuel 22 flowing into the fuel plenum 92 to facilitate more even heating and flow of the fuel 22 inside the fuel plenum 92.

Figure 8:
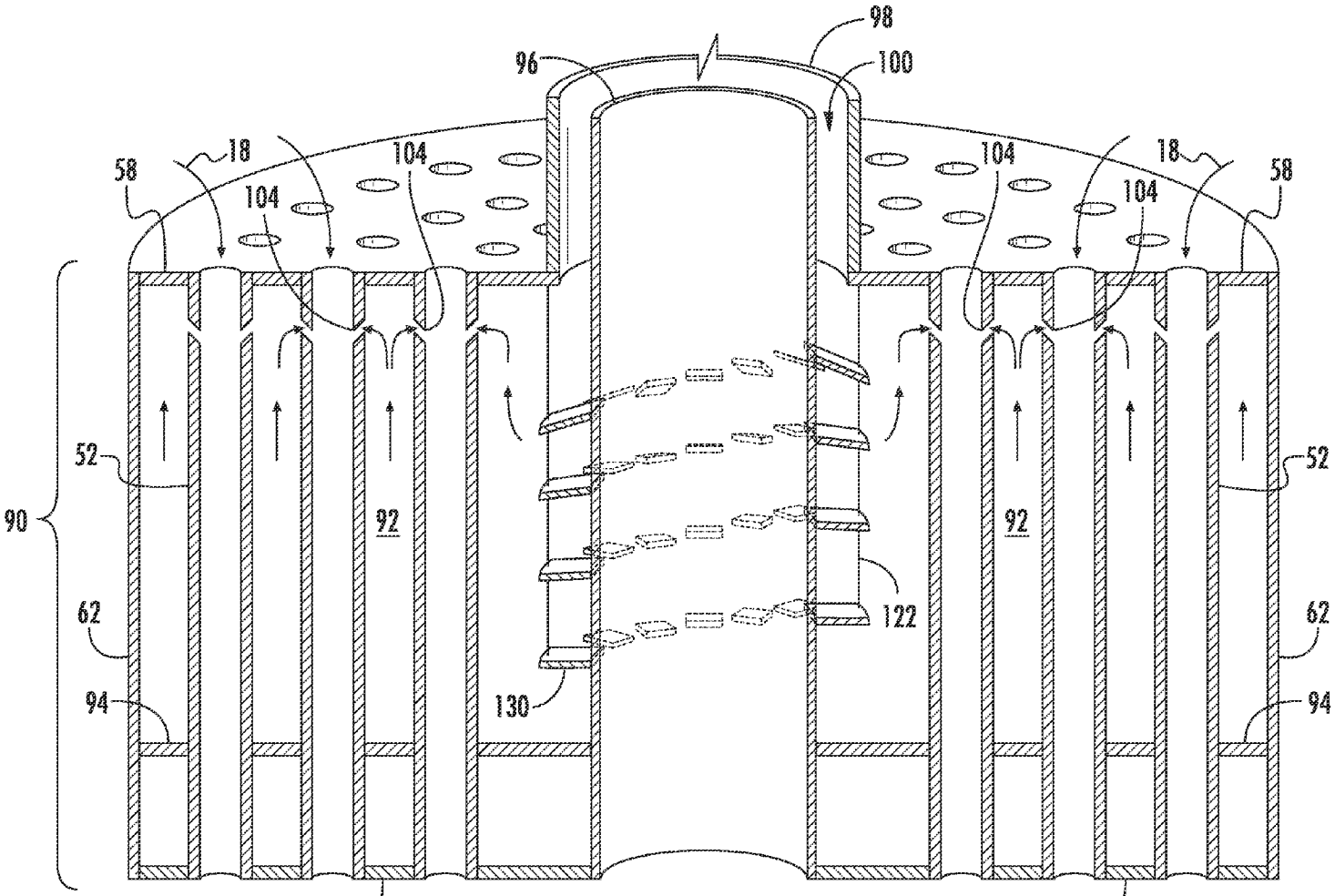
FIG. 8 is a partial perspective side cross-section view of a tube bundle according to a third embodiment of the present invention.
Figure 9:
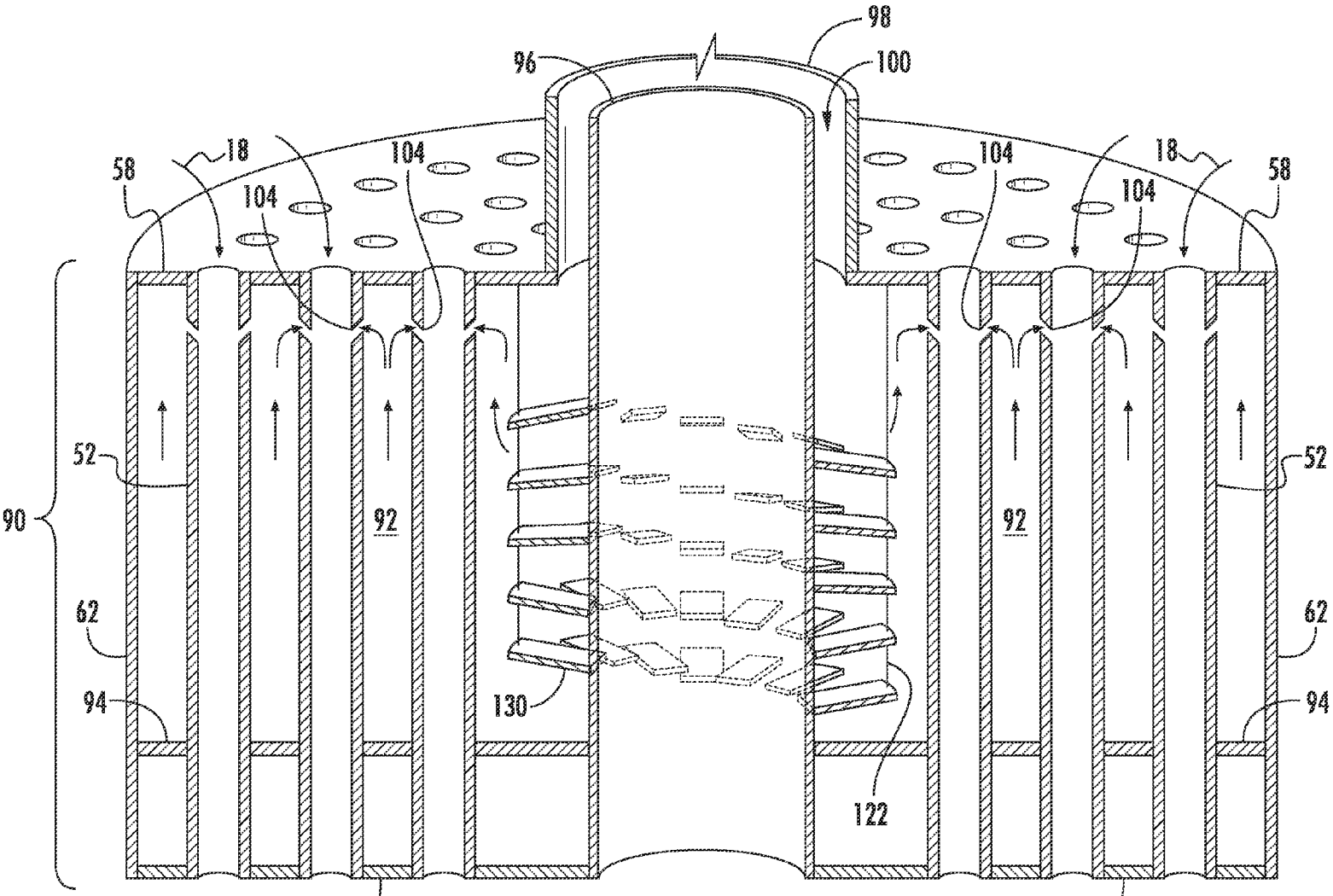
FIG. 9 is a partial perspective side cross-section view of a tube bundle according to a fourth embodiment of the present invention.

FIGS. 8 and 9 provide partial perspective side cross-section views of the exemplary tube bundle 90 according to third and fourth embodiments of the present invention. In the particular embodiments shown in FIGS. 8 and 9, the structure associated with the means for radially directing the fuel 22 inside the fuel plenum 92 is a plurality of straight guides 130 that extend radially from the inner conduit 96. The straight guides 130 are arranged axially inside the tube bundle 90 substantially parallel to the tubes 52 between the upstream surface 58 and the barrier 94. The length of the straight guides 130 may be the same or different, and the angle of the straight guides 130 with respect to the upstream surface 58 may vary. For example, in the particular embodiment shown in FIG. 8, the straight guides 130 closer to the upstream surface 58 and/or outer conduit 100 are angled with respect to the upstream surface 58, while the straight guides 130 closer to the barrier 94 are substantially parallel to the upstream surface 58. As another example, in the particular embodiment shown in FIG. 9, the length of the straight guides 130 gradually increases from the upstream surface 58 and/or outer conduit 98 to the barrier 94. In addition, the angle of the straight guides 130 changes from one direction, to horizontal, to the other direction as the straight guides 130 get closer to the barrier 94.

As shown in FIG. 8, the wire 122 or other structure may connect the straight guides 130 to the barrier 94 to support the straight guides 130 inside the fuel plenum 92. Alternately, as shown in FIG. 9, the wire 122 or other structure may connect the some of the straight guides 130 to the barrier 94 and other straight guides 130 to the upstream surface 58 and/or the outer conduit 98, as desired. In each embodiment shown in FIGS. 8 and 9, the straight guides 130 radially direct the fuel 22 flowing into the fuel plenum 108 to facilitate more even heating and flow of the fuel 22 inside the fuel plenum 92.

The various embodiments shown and described with respect to FIGS. 1-9 may also provide a method for distributing the fuel 22 in the combustor 20. For example, the method may include flowing the fuel 22 into the fuel plenum 92 defined at least in part by the upstream surface 58, tubes 52, shroud 62, and barrier 94. The method may further include radially directing the fuel 22 with the baffle that extends axially inside the fuel plenum 92 before flowing the fuel 22 through the fuel ports 104 and into the tubes 52. In this manner, the fuel 22 may be distributed radially around the tubes 52 before flowing into the tubes 52 to enhance even heating of the fuel 22 inside the fuel plenum 92.

The systems and methods described herein may provide one or more of the following advantages over existing nozzles and combustors. For example, the radial distribution of the fuel 22 around the tubes 52 enables the fuel 22 to flow more uniformly across all surfaces of the tubes 52. As a result, the heat exchange between the fuel 22 and the tubes 52 increases and reduces or eliminates localized hot spots along the tubes 52 that might lead to uneven heating of the fuel 22. The more uniform fuel 22 distribution through the fuel plenum 92 results in more even fuel 22 temperatures and flow through the fuel ports 104 and into the tubes 52, reducing any local hot streaks or high fuel concentrations in the combustion chamber 54 that might increase undesirable emissions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor, comprising:

a. a tube bundle that extends radially across at least a portion of the combustor, wherein the tube bundle comprises an upstream surface defined by a forward plate axially separated from a downstream surface defined by an aft plate;

b. a plurality of tubes that extend from the upstream surface through the downstream surface, wherein each tube provides fluid communication through the tube bundle;

c. a barrier that extends radially inside the tube bundle between the upstream and downstream surfaces;

d. a cylinder that extends axially from the forward plate to the barrier inside the tube bundle, wherein the cylinder, the barrier and the forward plate at least partially define a fuel plenum within the tube bundle, wherein the cylinder defines a plurality of perforations circumferentially spaced about the cylinder, wherein the plurality of perforations provide for fluid communication through the cylinder into the fuel plenum; and e. an inner conduit extending axially within the cylinder, wherein the inner conduit extends through the barrier plate and the aft plate, wherein the inner conduit and the cylinder define an annulus therebetween and wherein the perforations provide for fluid communication between the annulus and the fuel plenum.

2. The combustor as in claim 1, wherein the cylinder is connected to the barrier.

3. The combustor as in claim 1, wherein the cylinder is connected to the forward plate.

4. The combustor as in claim 1, wherein the cylinder extends substantially parallel to the plurality of tubes.

5. The combustor as in claim 1, wherein the perforations of the plurality of perforations are axially spaced along the cylinder.

6. A combustor, comprising:

a. a tube bundle that extends radially across at least a portion of the combustor, wherein the tube bundle comprises an upstream surface defined by a first plate;

b. a shroud that circumferentially surrounds the first plate to at least partially define a fuel plenum inside the tube bundle;

c. a plurality of tubes that extend through the upstream surface of the tube bundle, wherein each tube provides fluid communication through the tube bundle;

d. a second plate that extends radially inside the shroud downstream from the-upstream surface;

e. a cylinder that extends axially between the first plate and the second plate inside the tube bundle, wherein me first plate, the second plate, the shroud and the cylinder at least partially define the fuel plenum within the tube bundle, wherein the cylinder defines a plurality of perforations provide for fluid communication through the cylinder into the fuel plenum; and f. an inner conduit extending axially within the cylinder, wherein the inner conduit and the cylinder define an annulus therebetween and wherein the perforations provide for fluid communication between the annulus and the fuel plenum.

7. The combustor as in claim 6, wherein the cylinder is connected to the second plate.

8. The combustor as in claim 6, wherein the cylinder is connected to the upstream surface.

9. The combustor as in claim 6, wherein the cylinder extends substantially parallel to the plurality of tubes.

10. The combustor as in claim 6, wherein the combustor is incorporated into a turbomachine.

11. A gas turbine, comprising:

a. a compressor;

b. a combustor downstream from the compressor;

c. a turbine downstream from the combustor;

d. a tube bundle that extends radially across at least a portion of the combustor, wherein the tube bundle comprises an upstream surface defined by a forward plate axially separated from a downstream surface defined by an aft plate;

e. a shroud that circumferentially surrounds the upstream and downstream surfaces to at least partially define a fuel plenum inside the tube bundle;

f. a plurality of tubes that extend from the upstream surface through the fuel plenum and the downstream surface of the tube bundle, wherein each tube provides fluid communication through the tube bundle;

g. a barrier that extends radially inside the fuel plenum between the upstream, and downstream surfaces; and h. a cylinder that extends axially from the forward plate to the barrier inside the tube bundle, wherein the cylinder, the barrier and the forward plate at least partially define the fuel plenum within the tube bundle, wherein the cylinder defines a plurality of perforations circumferentially spaced about the cylinder, wherein the plurality of perforations provide for fluid communication through the cylinder into the fuel plenum; and i. an inner conduit extending axially within the cylinder, wherein the inner conduit extends through the barrier plate and the aft plate, wherein the inner conduit and the cylinder define an annulus therebetween and wherein the perforations provide for fluid communication between the annulus and the fuel plenum.

12. The gas turbine as in claim 11, wherein the cylinder is connected to the barrier.

13. The combustor as in claim 11, wherein the cylinder is connected to the upstream surface.

14. The combustor as in claim 11, wherein the perforations of the plurality of perforations are axially spaced along the cylinder.

* * * * *